US008701367B2

(12) United States Patent
Georgeau et al.

(10) Patent No.: US 8,701,367 B2
(45) Date of Patent: Apr. 22, 2014

(54) ROOFING SYSTEM AND METHOD

(75) Inventors: Philip C. Georgeau, Kalamazoo, MI (US); Lisa A. Mulder, Kalamazoo, MI (US)

(73) Assignee: Chem Link, Inc., Schoolcraft, MI (US)

( * ) Notice: Subject to any disclaimer, the term of this patent is extended or adjusted under 35 U.S.C. 154(b) by 940 days.

(21) Appl. No.: 10/726,341

(22) Filed: Dec. 3, 2003

(65) Prior Publication Data

US 2004/0107662 A1 Jun. 10, 2004

Related U.S. Application Data

(62) Division of application No. 10/061,545, filed on Feb. 1, 2002, now Pat. No. 6,679,018.

(51) Int. Cl.
*E04B 7/00* (2006.01)

(52) U.S. Cl.
USPC ..... 52/408; 52/741.4; 52/746.1; 52/309.8; 528/66; 428/141

(58) Field of Classification Search
USPC ..... 52/408–410, 309.7, 309.9, 309.11, 52/361–363, 344–345, 741, 746–747, 52/746.11, 745.19, 745.08, 741.4, 741.3, 52/741.1, 747.1, 756.1, 746.1, 309.4, 52/309.8, 783.11, 783.19, 796.1; 428/148–150, 331, 337, 451, 198, 913, 428/141; 528/66
See application file for complete search history.

(56) References Cited

U.S. PATENT DOCUMENTS

| | | | | |
|---|---|---|---|---|
| 2,667,131 | A * | 1/1954 | Clarvoe et al. | 52/420 |
| 3,468,086 | A * | 9/1969 | Warner | 52/173.1 |
| 3,632,557 | A | 1/1972 | Brode et al. | |
| 3,763,614 | A * | 10/1973 | Hyde et al. | 52/309.9 |
| 3,900,102 | A * | 8/1975 | Hurst | 206/411 |
| 3,971,184 | A * | 7/1976 | Van Wagoner | 428/201 |
| 4,141,187 | A * | 2/1979 | Graves | 52/173.1 |
| 4,393,634 | A * | 7/1983 | McDermott et al. | 52/309.1 |
| 4,445,306 | A * | 5/1984 | Schauffele | 52/410 |
| 4,498,267 | A * | 2/1985 | Beck | 52/555 |
| 4,507,437 | A | 3/1985 | Kato et al. | |
| 4,511,626 | A | 4/1985 | Schumacher | |
| 4,539,359 | A | 9/1985 | Kato et al. | |
| 4,559,263 | A * | 12/1985 | Roodvoets | 428/312.4 |
| 4,578,417 | A | 3/1986 | Furukawa et al. | |

(Continued)

FOREIGN PATENT DOCUMENTS

WO 0037534 6/2000

OTHER PUBLICATIONS

Exhibit A is a description of a prior art M-1 structural adhesive/sealant offered for sale at least as early as Jan. 1, 2001.

(Continued)

*Primary Examiner* — Jeanette E. Chapman
(74) *Attorney, Agent, or Firm* — Price Heneveld LLP

(57) ABSTRACT

A roof structure for covering a roof substrate includes a waterproof membrane having a layer of fleece material disposed on a first side thereof. The roof structure also includes a moisture curing, substantially non-volatile polyether based adhesive disposed on at least a portion of the first side of the waterproof membrane. At least some of the adhesive is disposed within the fleece material to permit bonding of the waterproof membrane to a roof substrate of a low slope roof of a building structure.

27 Claims, 1 Drawing Sheet

(56) References Cited

U.S. PATENT DOCUMENTS

| | | | | | |
|---|---|---|---|---|---|
| 4,588,637 | A | | 5/1986 | Chiu | |
| 4,608,792 | A | * | 9/1986 | Gerber | 52/199 |
| 4,640,730 | A | | 2/1987 | Streets et al. | |
| 4,677,800 | A | * | 7/1987 | Roodvoets | 52/309.12 |
| 4,693,923 | A | * | 9/1987 | McGroarty et al. | 428/148 |
| 4,719,723 | A | * | 1/1988 | Van Wagoner | 52/15 |
| 4,737,213 | A | * | 4/1988 | Paeglis et al. | 156/157 |
| 4,742,119 | A | | 5/1988 | Close | |
| 4,747,247 | A | * | 5/1988 | Petersen et al. | 52/408 |
| 4,852,323 | A | * | 8/1989 | Kartfilt | 52/410 |
| 4,860,514 | A | * | 8/1989 | Kelly | 52/410 |
| 4,894,426 | A | | 1/1990 | Baghdachi et al. | |
| 4,910,059 | A | * | 3/1990 | Sancaktar | 428/47 |
| 4,954,598 | A | | 9/1990 | Baghdachi et al. | |
| 4,965,119 | A | * | 10/1990 | Sancaktar | 428/192 |
| 4,996,803 | A | * | 3/1991 | Karrfalt et al. | 52/96 |
| 4,996,812 | A | * | 3/1991 | Venable | 52/408 |
| 5,097,053 | A | | 3/1992 | Baghdachi et al. | |
| 5,216,053 | A | * | 6/1993 | Jones et al. | 524/114 |
| 5,227,434 | A | | 7/1993 | Katz | |
| 5,227,442 | A | | 7/1993 | Babu et al. | |
| 5,242,727 | A | | 9/1993 | Briddell et al. | |
| 5,272,224 | A | | 12/1993 | Baghdachi et al. | |
| 5,296,561 | A | | 3/1994 | Babu et al. | |
| 5,298,572 | A | | 3/1994 | Katz | |
| 5,319,044 | A | | 6/1994 | Jung et al. | |
| 5,319,050 | A | | 6/1994 | Kimura et al. | |
| 5,368,943 | A | | 11/1994 | Baghdachi et al. | |
| 5,397,648 | A | | 3/1995 | Babu et al. | |
| 5,428,931 | A | * | 7/1995 | Ragsdale | 52/518 |
| 5,447,006 | A | * | 9/1995 | Zenor | 52/741.4 |
| 5,456,785 | A | * | 10/1995 | Venable | 156/229 |
| 5,572,843 | A | * | 11/1996 | Jordan | 52/410 |
| 5,620,554 | A | * | 4/1997 | Venable | 156/496 |
| 5,643,399 | A | * | 7/1997 | Venable | 156/494 |
| 5,721,311 | A | * | 2/1998 | Oien | 524/590 |
| 5,737,897 | A | * | 4/1998 | Naipawer, III | 52/796.1 |
| 5,753,747 | A | * | 5/1998 | Oien | 524/590 |
| 5,767,197 | A | | 6/1998 | Fukatsu et al. | |
| 5,768,838 | A | | 6/1998 | Georgeau | |
| 5,784,846 | A | * | 7/1998 | Godschalx | 52/409 |
| 5,800,891 | A | * | 9/1998 | Wasitis | 428/42.2 |
| 5,872,203 | A | | 2/1999 | Wen et al. | |
| 5,895,536 | A | * | 4/1999 | Starr et al. | 156/71 |
| 6,008,305 | A | * | 12/1999 | Wang et al. | 525/440 |
| 6,023,906 | A | * | 2/2000 | Folkersen | 52/746.11 |
| 6,048,579 | A | * | 4/2000 | Wang et al. | 427/387 |
| 6,077,896 | A | * | 6/2000 | Yano et al. | 524/308 |
| 6,101,767 | A | | 8/2000 | Georgeau | |
| 6,103,356 | A | * | 8/2000 | Messenger | 428/215 |
| 6,103,850 | A | * | 8/2000 | Reichel et al. | 528/60 |
| 6,106,941 | A | | 8/2000 | Fisher et al. | |
| 6,124,387 | A | | 9/2000 | Wang et al. | |
| 6,130,268 | A | * | 10/2000 | Murray | 521/131 |
| 6,151,855 | A | * | 11/2000 | Campbell | 52/408 |
| 6,193,826 | B1 | * | 2/2001 | Starr et al. | 156/71 |
| 6,206,991 | B1 | * | 3/2001 | Starr | 156/71 |
| 6,253,530 | B1 | | 7/2001 | Price et al. | |
| 6,258,878 | B1 | | 7/2001 | Bahadur et al. | |
| 6,271,333 | B1 | | 8/2001 | Okuhira | |
| 6,291,571 | B1 | | 9/2001 | Fisher | |
| 6,297,324 | B1 | | 10/2001 | Briddell et al. | |
| 6,305,143 | B1 | | 10/2001 | Streets et al. | |
| 6,314,700 | B2 | * | 11/2001 | Starr | 52/540 |
| 6,355,127 | B1 | * | 3/2002 | Mahdi et al. | 156/155 |
| RE37,683 | E | | 4/2002 | Briddell et al. | |
| 6,401,925 | B1 | | 6/2002 | Wang et al. | |
| 6,465,104 | B1 | * | 10/2002 | Krebs et al. | 428/423.1 |
| 6,491,471 | B1 | * | 12/2002 | Susinskas | 404/73 |
| 6,505,455 | B1 | | 1/2003 | Georgeau | |
| 6,544,909 | B1 | * | 4/2003 | Venkataswamy et al. | 442/38 |
| 6,579,924 | B2 | * | 6/2003 | Georgeau et al. | 524/376 |
| 6,581,348 | B2 | * | 6/2003 | Hunter, Jr. | 52/408 |
| 6,679,018 | B2 | * | 1/2004 | Georgeau et al. | 52/408 |
| 6,701,685 | B2 | * | 3/2004 | Rippey | 52/408 |
| 6,742,313 | B2 | * | 6/2004 | Ritland et al. | 52/408 |
| 6,764,733 | B1 | * | 7/2004 | Clarke | 428/40.3 |
| 6,769,215 | B1 | * | 8/2004 | Carkner | 52/411 |
| 6,871,472 | B2 | * | 3/2005 | Folkersen | 52/746.11 |
| 6,938,386 | B2 | * | 9/2005 | Ritland et al. | 52/408 |
| 7,169,719 | B2 | * | 1/2007 | Mehta et al. | 442/2 |
| 2002/0086942 | A1 | * | 7/2002 | Fujita et al. | 525/100 |
| 2003/0209305 | A1 | * | 11/2003 | Smith et al. | 156/71 |
| 2005/0107499 | A1 | * | 5/2005 | Georgeau et al. | 524/59 |

OTHER PUBLICATIONS

Exhibit B is a specification of a prior art M-1 structural adhesive/sealant offered for sale at least as early as Jan. 1, 2001.

Exhibit C is a Material Safety Data Sheet of a prior art M-1 structural adhesive/sealant offered for sale at least as early as Jan. 1, 2001.

* cited by examiner

ROOFING SYSTEM AND METHOD

CROSS-REFERENCE TO RELATED APPLICATION

The present application is a divisional application of U.S. patent application Ser. No. 10/061,545, filed on Feb. 1, 2002, now issued U.S. Pat. No. 6,679,018, the entire contents of which are incorporated by reference.

BACKGROUND OF THE INVENTION

Various low slope roofing systems have been developed for buildings and the like. Such low slope roofing systems commonly include a structural deck that is metal or concrete. The deck may then be covered with a layer of insulation, and the insulation is then covered with a waterproof membrane. Wind acting on the building structure may cause a substantial uplift force acting on the roof membrane. The membrane in known systems may be secured utilizing ballast such as gravel to prevent uplift of the membrane. Alternately, the membrane may be adhesively bonded with hot asphalt, or flammable solvent based contact bond adhesives. Other known systems utilize a two component, sprayable polyurethane foam adhesive primarily composed of di-isocyanate and polyol compounds. Such polyurethane foam arrangements utilize a spray gun that mixes the components and sprays the liquid mixture on the substrate. The membrane is immediately applied and the adhesive mixture then expands, or foams, and solidifies to form a bond. However, such polyurethane foam adhesive arrangements may suffer from numerous drawbacks. For example, the spraying of the polyurethane adhesive produces a potentially hazardous aerosol, requiring use of protective suits, respiratory protection, or the like in order to protect those spraying the adhesive and applying the roof membrane. Furthermore, inclement weather conditions also may create problems with such systems due to high wind or low temperatures. The spraying equipment required to spray such foam is generally quite large and heavy, thereby requiring substantial effort to position the equipment on the building roof. Such equipment also includes numerous components such that it is also quite expensive and often difficult to maintain.

Flammable, solvent based contact bond adhesives require that adhesive be spread on both bonding surfaces by brush, roller, or spray, and that they also remain in an unassembled condition until the majority of the solvent evaporates into the atmosphere. The coated substrates are then assembled and compressed with a metal roller to set the bond. Such applications of roof membrane are labor intensive, time consuming, and present certain occupational hazards to personnel breathing hazardous solvent vapors. Such "solvent release" type adhesives also contaminate the atmosphere with volatile organic compounds. The solvents may also become trapped below the membrane, causing blisters and delamination requiring repair.

Such existing polyurethane foam adhesive systems and solvent based adhesive systems may provide sufficient bond strength to meet roofing industry standards. However, building roof structures may experience uplift forces exceeding such standards, such that substantial damage may be incurred, even by buildings that meet standards. In addition to the damage to the building, items within the building such as stored products or other inventory, production equipment, office equipment, computers, and the like may also suffer serious damage. Due to the large numbers of buildings utilizing membrane type roof structures, such damage can be extremely costly, especially in geographic areas that experience hurricanes or other high wind conditions.

Although moisture curing adhesives have been used to bond structural components such as capping, metal edges, skylights, roof insulation and the like, it is not believed that such adhesives have heretofore been utilized to bond waterproof roof membranes to low slope roof substrates.

SUMMARY OF THE INVENTION

One aspect of the present invention is a roof substrate (or board) for covering a structural roof (deck) substrate. The roof structure includes a waterproof membrane having a layer of "fleece" (non-woven textile) material disposed on a first side thereof. The roof structure also includes a moisture curing, substantially non-volatile polyether based adhesive disposed on at least a portion of the roof substrate (board). At least some of the adhesive is disposed within the fleece material to permit bonding of the waterproof membrane to a roof substrate of a low slope roof of the building structure.

Another aspect of the present invention is a roof deck structure including a rigid low slope roof structure adapted to be supported at least in part by the walls of a building. The low slope roof structure has a rigid roof substrate, and the roof deck structure includes a waterproof membrane having a layer of fleece material disposed on a first side thereof. The roof deck structure further includes a moisture curing, substantially non-volatile polyether based adhesive disposed on at least a portion of the first side of the waterproof membrane. At least some of the adhesive is disposed within the fleece material and bonds the waterproof membrane to the roof substrate.

Yet another aspect of the present invention is a method of securing a waterproof membrane to a low slope roof structure. The method includes applying a plurality of beads of a moisture curing adhesive onto the lowest slope roof structure. A waterproof membrane is positioned over at least a portion of the lowest slope roof structure in contact with the moisture curing adhesive. The moisture curing adhesive is activated by exposure to atmospheric moisture thus polymerizing the adhesive and securely bonding the waterproof membrane to the lowest slope roof structure.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
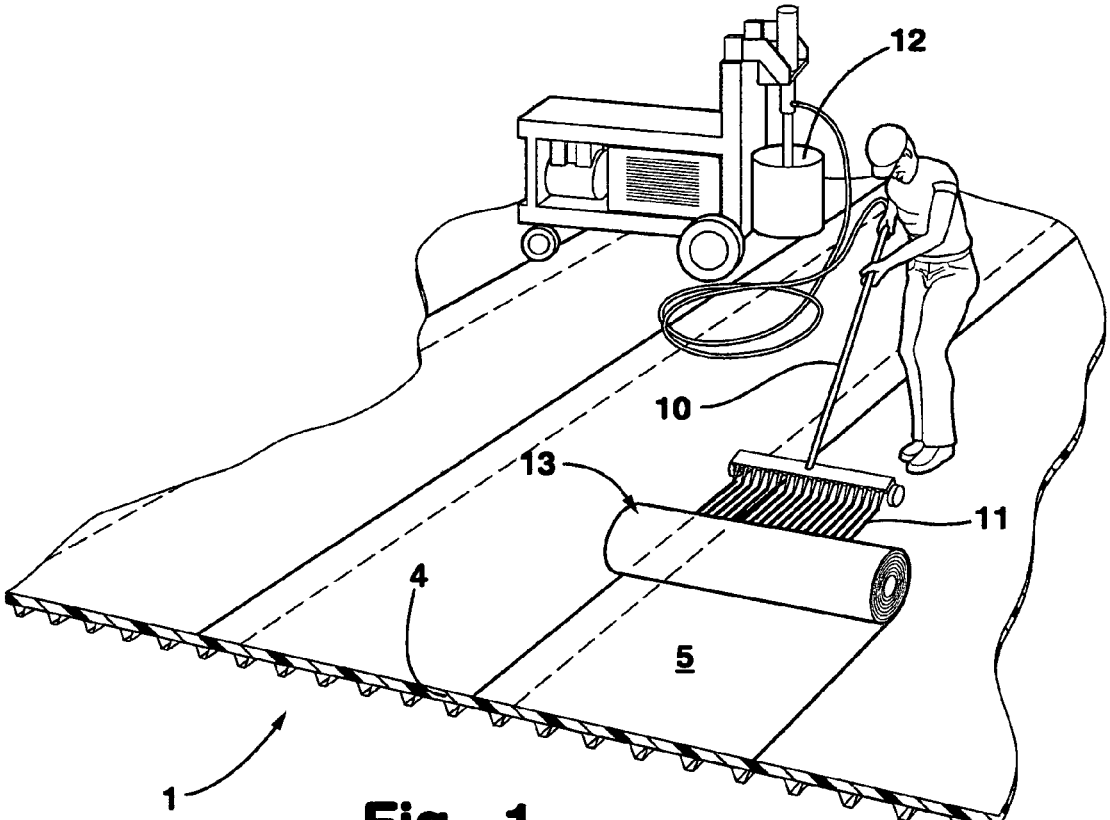
FIG. 1 is a partially schematic, fragmentary perspective view showing a roof structure and application equipment embodying one aspect of the present invention.
Figure 2:
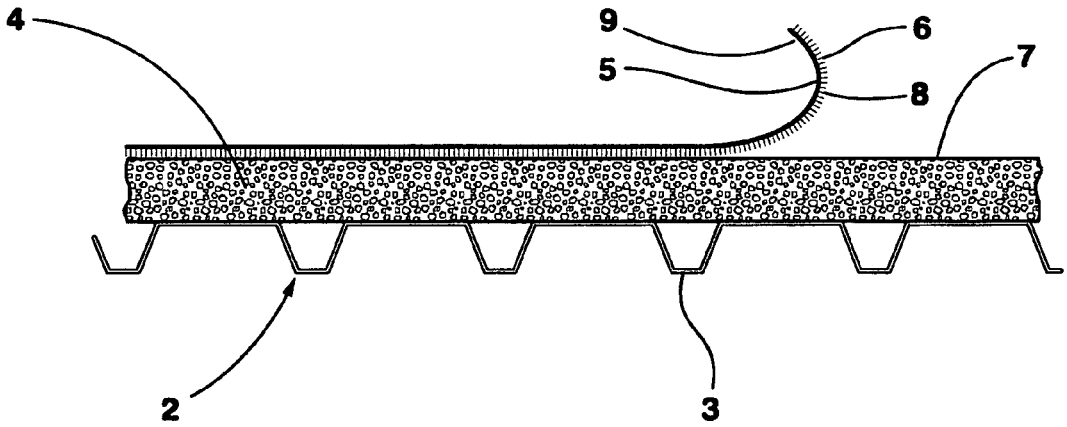
FIG. 2 is a fragmentary, cross-sectional view of the roof structure of FIG. 1.

For purposes of description herein, the terms "upper," "lower," "right," "left," rear, "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1 and 2, a roof deck structure 1 according to one aspect of the present invention includes a rigid low slope roof structure 2 that may include a metal deck 3 and a roof substrate such as a layer of insulation 4. A waterproof membrane 5 has a layer of fleece 6 disposed on a first side thereof. Moisture curing adhesive, such as a non-volatile polyether based adhesive is disposed on at least a portion of the first side 8, and at least some of the adhesive 7 is disposed within the fleece 6 and thereby bonds the waterproof membrane 5 to the roof substrate such as the insulation 4. Although the fleece backed membrane 5 is illustrated as being bonded to a layer of insulation, the membrane 5 could also be bonded to other roof substrate materials utilizing the moisture curing adhesive 7 according to the present invention.

In a preferred embodiment, the fleece backed membrane 5 includes a layer of EDPM rubber on an upper surface to provide a waterproof layer, and the lower side includes a non-woven polyester matting. The EDPM layer is preferably about 40-70 mils, and the fleece-like matting has a thickness of about 40-80 mils secured thereto. Such fleece backed membranes are manufactured by Carlisle Syntec Company, of Carlisle, Pa. Other fleece-backed membranes include Sarnafil PVC membrane, and GAF TPO membrane.

In a preferred embodiment, moisture curing adhesive 7 is designated as "ROOF ASSEMBLY ADHESIVE" that is available from Chem Link Corporation of Kalamazoo, Mich. This adhesive does not generate toxic vapors, and also does not require immediate application of the membrane as with existing two part polyurethane foam sprayed systems. This adhesive can be used at temperatures below 40°, and, because it is extruded directly to the rigid deck, it is not adversely affected by wind or the like during application. The rheology (consistency) of this adhesive is designed to produce, upon extrusion, a round bead that maintains its profile (shape) after application to a rigid surface. In a preferred embodiment, the adhesive 7 has a viscosity of about 200,000 to 300,000 centipoise. This viscosity level permits extrusion, yet provides high profile beads. Viscosities as low as about 100,000 centipoise or as high as about 500,000 centipoise may be utilized. Such high profile beads of adhesive improve contact and transfer of the adhesive to the flexible membrane surface and bridge gaps that may exist as a result of roughness or irregularity in the rigid surface. Furthermore, this adhesive develops a tensile strength of about 200 pounds per square foot, and therefore provides a very strong bond between the membrane 5 and the roof substrate 4. Thus, the roof structure of the present invention is very strong and resistant to wind uplift forces that would otherwise cause the membrane 5 to separate from the substrate 4. Prior to application of the adhesive 7, the roof substrate 4 is cleaned as required to ensure that it is free of oil, dirt, or loose debris. Also, the roof substrate 4 must be relatively dry. However, extensive, time consuming treatment such as blasting, primers, chemical treatments and the like used with existing polyurethane foam systems are not required when utilizing the Roof Assembly Adhesive according to the present invention.

With reference to FIG. 1, during assembly a multi-bead mastic adhesive extrusion applicator is utilized to apply a plurality of parallel beads 11 of the adhesive 7 to the roof structure 4. Notably, the multi-bead extrusion applicator and pail 12 are relatively light weight and easy to use. One example of a suitable multi-bead applicator is a Keller applicator that is made by Keller Manufacturing of Kalamazoo, Mich. Such applicators may apply up to 24 beads at a time on two inch centers, covering an area that is about 48 inches wide. Because a large number of beads are applied simultaneously, the adhesive can be quickly applied to large areas of the roof substrate. After the beads 11 of the adhesive 7 are applied to a section of the roof, a roll 13 of the fleece backed membrane 5 is unrolled to position the membrane 5. A weighted roller is then rolled over the membrane 5 to compress two beads, thereby increasing the bond surface area and wetting the membrane 5 and roof structure. The seams between adjacent strips of the fleece 5 are sealed utilizing conventional heat welding or tape, and the roof penetrations, edges, and the like are also sealed using known techniques. After the membrane 5 is positioned, the ambient water vapor that naturally occurs in outdoor conditions causes the adhesive 7 to cure. The adhesive 7 will cure to a firm and secure bond in one hour and achieve full bond strength in less than three days at 40° F. or above. Temperatures below 40° F. (between 30° and 40° F.) extend the period of ultimate strength development to seven days. Although fleece-backed waterproof membrane material is one aspect of the present invention, the invention is not limited to the use of such material and alternative waterproof membranes can be used without a fleece bonding surface. Such alternative membranes can be composed of ethylene propylene dimer (EPDM), polyvinyl chloride (PVC), polyisobutylene (PIB) and certain thermoplastic polyolefin (TPO) membranes. The invention further includes any waterproof membrane to which the described polyether moisture cure adhesive provides sufficient adhesion to form a permanent bond.

The moisture curing adhesive, in accordance with a preferred embodiment of this invention, comprises a silyl-terminated polymer, and pigments that impart viscosity and mechanically reinforce the cured adhesive. The adhesive also includes a plasticizer to impart elastomeric properties to the cured adhesive, and a thixotropic material that imparts viscosity and maintains the shape of the adhesive bead after extrusion. An antioxidant compound in the adhesive protects the polymer from thermal degradation, aging, and prolonged exposure to oxygen, and a catalyst promotes a polymerization reaction upon exposure to moisture. Adhesion promoters in the adhesive react with construction material surfaces forming permanent a chemical bond.

Examples of silyl-terminated polymers that may be used include silylated polyurethane, silylated polyethers, silylated acrylates, and sylylated polyesters. The silylated polymers, or silyl-terminated polymers of this invention include two or more reactive silyl groups, with alpha, omegatelechelic silane-terminated polymers being preferred.

An example of a suitable sylyl terminated polymer that may be used is an oxyalkylene polymer having at least one reactive silyl group at each end of the polymer molecule. The backbone of the silyl-terminated polymer has repeating units represented by the formula: —R—O— wherein R represents a divalent organic group. A straight or branched alklene group containing 1 to 14 carbon atoms is preferable. More preferably straight or branched alkylene groups containing 2 to 4 carbon atoms are utilized. Especially preferred are polypropylene oxide backbones, polyethylene oxide backbones oxide backbones, and copolyethylene oxide/polypropylene oxide backbones. Other repeating units may include, but are not limited to —CH2O—O—, —CH2CH(CH3)O—, —CH2CH(C2H5)O—, —CH2C(CH3)2O—, CH2CH2CH2CH2O— and the like.

The reactive silyl group contained in the silyl-terminated polymers may be represented by the formula:

$$—[Si(R2)_{2-a}(X)_aO]_p—Si(R3)_{3-b}(X)_b$$

wherein R2 and R3 are the same or different and each represents an alkyl group containing 1 to 20 carbon atoms. An aryl group containing 6 to 20 carbon atoms, an aralkyl group containing 7 to 20 carbon atoms, or a triorganosiloxy group of the formula $(F4)_3SiO$— (wherein R4 independently represents a hydrocarbon group containing 1 to 20 carbon atoms).

EXAMPLES

The following examples illustrate the adhesive utilized for the present invention in further detail, but do not limit the scope of this invention. An example of a moisture curable adhesive composition in accordance with one aspect of this invention was prepared by mixing the following ingredients under process conditions that protect the compound from exposure to atmospheric moisture. For example, processing may be done under a vacuum, or under a dry nitrogen atmosphere.

| | | |
|---|---|---|
| Base Polymer I | MS-303 sylyl-terminated polyether | 12.7 |
| Base Polymer II | MS-203 sylyl-terminated polyether | 5.8 |
| Plasticizer | Diisodecyl Pthalate | 15.5 |
| Reinforcing Pigment | 3 micron calcium carbonate | 58.4 |
| Antioxidant | Lowinox 22M46, hindered phenol | 4 |
| Thixotrope | Cravellac Super, polyamide | 1 |
| Catalyst | Foamrez SU11A, organotin | 0.4 |
| Dehydration Agent | A-171, vinyl silane | 0.6 |
| Adhesion Promoter | A-1120, aminosylane | 1.6 |
| | Total | 100 parts |

Another example of a moisture curing adhesive composition in accordance with this invention was prepared by mixing the following ingredients in a moisture free atmosphere.

| | | |
|---|---|---|
| Base Polymer | Desmoseal LS 2237, silyl-terminated polyurethane | 18.5 |
| Plasticizer | diisodecyl pthalate | 15.5 |
| Reinforcing Pigment | calcium carbonate, 3 micron | 58.4 |
| Antioxidant | Lowinox 22M46, hindered phenol | 4 |
| Thixotrope | Crayvellac Super, polyamide | 1 |
| Catalyst | Foamrez SU11A, organotin | 0.4 |
| Dehydration Agent | A-171, vinyl silane | 0.6 |
| Adhesion Promoter | A-1120, amino silane | 1.6 |
| | Total | 100 parts |

The above formulations exhibit fast setting properties, adhesion and bond strength and rheological properties sufficient to install fleece-back waterproof membranes and most non-fleece-backed membrane under field roofing conditions.

The sheer strength of both compounds tested on wood substrates under identical conditions were in excess of 200 pounds per square foot.

Resistance to wind uplift is tested at Underwriters Laboratory in accordance with test method UL 1897. The testing device used in this test is a 10'×10' table upon which a roof deck is installed. A complete roof assembly is constructed on the deck, including the roof membrane. A steel cupola is placed over the roof assembly and sealed at the perimeter to prevent air leaks. The atmosphere in the sealed cupola is reduced thus applying a vertical lifting force over the surface of the roof membrane. The vacuum force applied to the test surface is measured in inches of water and translated into pounds per square foot. Typical wind uplift performance meeting most roofing industry standards is 90 pounds per square foot.

Three tests were run using 8'×8' Underwriters Laboratory UL 1879 type table with the following roof construction. Fluted steel deck, "B" type covered with two inch thick polyisocyanurate insulation board (Atlas Insulation) bonded to the steel with parallel ¼" diameter beads of Roof Assembly Adhesive applied to the steel at six inch intervals. Fiberglass reinforced gypsum board (Dens-Deck) was then bonded to the insulation with parallel ⅛" diameter beads of Roof Assembly Adhesive applied to the insulation at two inch intervals. A PVC fleece-backed waterproof membrane was then bonded to the gypsum board using ⅛" diameter beads of Roof Assembly Adhesive applied at two inch intervals.

Each test assembly was allowed to cure at room temperature for three days. The three tables were tested to destruction with the following results: 165 pounds per square foot, 185 pounds per square foot and 205 pounds per square foot. These results are substantially better than prior solvent and polyurethane foam systems. In all the test assemblies the mode of failure was a complete removal of the fiberglass facing on the gypsum board. No adhesive failure occurred within any of the assemblies. Variability in the three tests were attributed to variation in the surface strength of the gypsum board substrates. Each test roof substantially exceeded the performance standard of the roofing industry.

The roofing system and method of the present invention provide a low slope roof structure that is very resistant to wind uplift forces and damage that would otherwise result from such wind forces. Furthermore, the moisture curing adhesive according to the present invention is not hazardous to the workers installing the roof, and the moisture cure adhesive can be applied at temperatures as low as 30° F. Significantly, the adhesive composition and roof system according to the present invention may be used in communities having laws that prohibit or restrict the use of construction materials that release solvent (volatile organic compounds) into the atmosphere. Also, extensive treatment of the roof substrate (e.g. concrete deck) to which the membrane is being bonded is not required. Rather, a relatively simple cleaning operation is sufficient for most applications, such that extensive preparation, treatment and the like is avoided.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A roof structure for covering a roof substrate, comprising:

a roof substrate having a sloped upper surface;

a waterproof membrane having an upper side and a lower side that is substantially free of fleece material;

a moisture curing substantially non-volatile adhesive comprising a silyl-terminated polymer disposed on at least a portion of said lower side of said waterproof membrane in contact with said upper surface of said roof substrate and bonding said, waterproof membrane to said roof substrate to define a portion of a low slope roof of a building structure, wherein the adhesive has sufficient viscosity to form beads on the sloped roof substrate upon extrusion of the adhesive onto the sloped upper surface of the roof substrate.

2. The roof structure of claim 1, wherein:
said silyl-terminated polymer comprises a silyl-terminated polyether.
3. The roof structure of claim 1, wherein:
said waterproof membrane comprises a layer of PVC material.
4. The roof structure of claim 1, wherein:
said waterproof membrane comprises a layer of EPDM rubber.
5. A roof deck structure, comprising:
a rigid low slope roof structure adapted to be supported at least in part by the walls of a building, said low slope roof structure having a roof substrate defining a sloped upper surface;
a waterproof membrane having an upper side and a lower side;
a moisture curing silyl-terminated polymer based adhesive disposed on at least a portion of said lower side in contact with said upper surface of said roof substrate, and bonding said waterproof membrane to said upper surface of said roof substrate, wherein the adhesive has sufficient viscosity to form beads on the sloped roof substrate upon extrusion of the adhesive onto the sloped upper surface of the roof substrate.
6. The roof deck structure of claim 5, wherein:
said polymer comprises a silyl-terminated polyether.
7. The roof structure of claim 5, wherein:
said waterproof membrane comprises a layer of EPDM rubber that does not include fleece backing material.
8. A roof deck structure, comprising:
a rigid low slope roof structure including a roof substrate having a sloped upper surface;
a waterproof flexible membrane covering said roof substrate, and defining a lower surface;
a moisture curing substantially non-volatile adhesive comprising a silyl-terminated polymer in contact with the upper surface of the roof substrate and the lower surface of the flexible membrane to thereby bond the flexible membrane to the roof substrate.
9. The roof deck structure of claim 8, wherein:
the adhesive comprises a silyl-terminated polyether based adhesive.
10. The roof deck structure of claim 9, wherein:
the flexible membrane includes a layer of fleece matting on one side; and wherein:
at least a portion of the adhesive is disposed in the fleece.
11. The roof deck structure of claim 10, wherein:
the flexible membrane comprises a layer EDPM rubber having a thickness of about 0.040-0.070 inches thick.
12. The roof deck structure of claim 11, wherein:
the fleece matting has a thickness of about 0.040-0.080 inches.
13. The roof deck structure of claim 8, wherein:
the flexible membrane is bonded to the roof substrate and has a bond strength of at least one hundred sixty-five pounds per square foot.
14. The roof deck structure of claim 13, wherein:
the adhesive has a viscosity prior to curing of about 200,000 to 300,000 centipoise.
15. The roof deck structure of claim 8, wherein:
the roof substrate comprises fiberglass reinforced gypsum board.
16. A roof deck structure, comprising:
a rigid low slope roof structure including a roof substrate comprising fiberglass reinforced gypsum board;
a waterproof flexible membrane covering said roof substrate;
a moisture curing substantially non-volatile adhesive disposed between the roof substrate and the flexible membrane to thereby bond the flexible membrane to the roof substrate; and wherein:
the roof deck structure includes a layer of foam insulation below the fiberglass reinforced gypsum board.
17. A roof deck structure, comprising:
a rigid low slope roof structure including foam insulation forming a roof substrate;
a waterproof flexible membrane covering said roof substrate;
a moisture curing substantially non-volatile adhesive disposed between the roof substrate and the flexible membrane to thereby bond the flexible membrane to the roof substrate;
a fluted steel deck below the foam insulation; and
moisture curing adhesive bonding the foam insulation to the steel deck without the use of mechanical fasteners.
18. The roof deck structure of claim 17, including:
moisture curing adhesive bonding the foam insulation to the steel deck.
19. The roof deck structure of claim 18, wherein:
the adhesive includes a silyl-terminated polymer.
20. The roof deck structure of claim 18, wherein:
the adhesive includes an oxyalkylene polymer having at least one reactive silyl group at each end of the polymer molecule.
21. A roof deck structure, comprising:
a fluted steel deck having a plurality of elongated upper deck surfaces;
a substantially rigid panel disposed on the steel deck, the panel defining upper and lower surfaces;
moisture-curing adhesive disposed between the steel deck and the substantially rigid panel in contact with the upper deck surfaces and the lower surface of the substantially rigid panel; and
a flexible waterproof membrane disposed above the substantially rigid panel.
22. The roof deck structure of claim 21, wherein:
the substantially rigid panel comprises insulation board.
23. The roof deck structure of claim 22, including:
a layer of fiberglass reinforced gypsum board disposed between the insulation board and the waterproof membrane.
24. The roof deck structure of claim 23, including:
moisture curing adhesive adhesively securing the fiberglass reinforced gypsum board to the insulation board.
25. The roof deck structure of claim 23, including:
moisture curing adhesive securing the waterproof membrane to the fiberglass reinforce gypsum board.
26. The roof deck structure of claim 21, wherein:
the waterproof membrane comprises a fleece-backed material.
27. The roof deck structure of claim 21, wherein:
the waterproof membrane comprises a fleece-backed PVC material.

* * * * *